US007639216B2

(12) United States Patent
Tang et al.

(10) Patent No.: US 7,639,216 B2
(45) Date of Patent: Dec. 29, 2009

(54) ELECTROLUMINESCENT DISPLAY DEVICE AND METHOD OF DRIVING SAME

(75) Inventors: Yu-Chun Tang, Kaohsiung Hsien (TW); Cheng-Nan Yeh, Taoyuan (TW)

(73) Assignee: AU Optronics Corp., Hsinchu (TW)

( * ) Notice: Subject to any disclaimer, the term of this patent is extended or adjusted under 35 U.S.C. 154(b) by 653 days.

(21) Appl. No.: 11/395,182

(22) Filed: Apr. 3, 2006

(65) Prior Publication Data

US 2006/0267049 A1 Nov. 30, 2006

(30) Foreign Application Priority Data

May 24, 2005 (TW) ..... 94116931 A

(51) Int. Cl.
*G09G 3/30* (2006.01)

(52) U.S. Cl. ..... 345/76; 345/89; 345/99; 345/204; 345/210; 345/690

(58) Field of Classification Search ..... 345/76, 345/89, 99, 204, 210, 690
See application file for complete search history.

(56) References Cited

U.S. PATENT DOCUMENTS 5,973,660 A * 10/1999 Hashimoto ..... 345/98
6,535,191 B1 * 3/2003 Miyachi ..... 345/94
6,677,713 B1 1/2004 Sung
6,710,757 B2 3/2004 Wu
6,753,654 B2 6/2004 Koyama
6,903,716 B2 * 6/2005 Kawabe et al. ..... 345/99
6,927,766 B2 * 8/2005 Tagawa et al. ..... 345/204
2001/0026251 A1 * 10/2001 Hunter et al. ..... 345/55
2002/0118150 A1 * 8/2002 Kwon ..... 345/76
2004/0207580 A1 * 10/2004 Yaguma et al. ..... 345/76
2005/0035932 A1 * 2/2005 Nishikawa et al. ..... 345/76
2005/0093804 A1 * 5/2005 Yamazaki et al. ..... 345/92
2005/0140606 A1 * 6/2005 Choi et al. ..... 345/76
2005/0157581 A1 * 7/2005 Shiurasaki et al. ..... 365/230.06
2005/0168491 A1 * 8/2005 Takahara et al. ..... 345/690
2005/0179677 A1 * 8/2005 Nojiri et al. ..... 345/204
2005/0270258 A1 * 12/2005 Shin ..... 345/76
2006/0145976 A1 * 7/2006 Tsai et al. ..... 345/87

* cited by examiner

*Primary Examiner*—Bipin Shalwala
*Assistant Examiner*—Vince E Kovalick
(74) *Attorney, Agent, or Firm*—Birch, Stewart, Kolasch & Birch, LLP

(57) ABSTRACT

An electroluminescent display device is composed of a plurality of rows of pixels, each at least including a light emitting element, a switching transistor, and a driving transistor electrically coupled to the switching transistor and the light emitting element. A frame image is shown on the electroluminescent display device in a display period having a first time interval, a second time interval, and a third time interval. These rows of pixels are activated in order during the first time interval and the second time interval. And then, a display data is provided for these rows of pixels during the first time interval, subsequently a gray level data is provided for these rows of pixels during the second time interval, then these rows of pixels are reset during the third time interval.

19 Claims, 10 Drawing Sheets

ELECTROLUMINESCENT DISPLAY DEVICE AND METHOD OF DRIVING SAME

This application claims the benefit of Taiwan Application Serial No. 094116931, filed May 24, 2005, the subject matter of which is incorporated herein by reference.

BACKGROUND OF THE INVENTION

1. Field of the Invention

The invention relates to an electroluminescent display device and the method of driving the same, and more particularly to a TFT electricity reset process utilized in an electroluminescent display device and the driving method thereof.

2. Description of the Related Art

As an electric current driven device, the organic light emitting diode has a property that it emits light having intensity in proposition to the current through the light emitting diode. In general, Low Temperature Poly Silicon Thin Film Transistor (LTPS-TFT) and Amorphous Silicon Thin Film Transistor (a-Si TFT) are most popular technology used to fabricate the active element of the organic light emitting diode. In practice, the Poly Silicon technology is often utilized. However, due to less mask processes, lower temperature, and low cost, developing a-Si TFT technology is a tendency. After a long term use, due to some material characteristics and circuit design, the active element (no matter LTPS TFT or a-Si TFT) of the organic light emitting diode will suffer from raised threshold voltage and lowered turn-on current. It is especially true for the a-Si TFT technology.

When a-Si TFT is used as an active element of a electroluminescent display panel, and the active element is turned on for conducting current, a large current will flow through the channel of the a-Si TFT. Due to the foregoing scenario, it tends to trap the electron of the current in the gate dielectric, results in raise of the threshold voltage of the a-Si TFT, as well as drop of turn-on current through the a-Si TFT. Subsequently, it descends—the luminance of the organic light emitting diode, and reduces the life of the display panel.

Due to the problems mentioned above, when the a-Si TFT is utilized in the electroluminescent display panel, its sequence of driving is different from that of the electroluminescent display panel utilizing LTPS TFT as active element. As widely used in electroluminescent display panel, the LTPS TFT acts as active element, and it is necessary to continue refreshing the display panel. However, when it comes to a-Si TFT, in addition to refreshing the display panel, a "TFT electricity reset sequence" is made possible, and the life of the a-Si TFT used in the electroluminescent display is extended.

In FIG. 1A, it schematically illustrates the circuit diagram of the pixel matrix of the active matrix type electroluminescent display device. As shown in FIG. 1A, the display panel includes M scan lines, N data lines, and M times N (M×N) pixels, which are used to graphically illustrate an image signal composed of a plurality of frames. According to FIG. 1A, the OLED (organic light emitting diode) D (1,1) in the pixel P (1,1) is driven by both TFT Ta (1,1) (thin film transistor) and TFT Tb (1,1), wherein the source and gate of Ta (1,1) are coupled to the data line Data (1) and scan line Scan (1), respectively.

FIG. 1B is a timing chart of a plurality of driving pulse sequences, which in combination with FIG. 1A can be used to explain the operation of a traditional active matrix type electroluminescent display device. As shown in FIG. 1B, the period from the beginning of a specific scan line selection to the beginning of the next selection of the foregoing specific scan line is defined as display period I, it is also the time interval required to show a frame on the display panel. The display panel of the active matrix type electroluminescent display device in the related art can be driven by the method including the step of: subsequently scanning each row of pixel P, i.e., subsequently applying a positive pulse to scan lines, Scan (1) to Scan (M), thus each of the transistor Ta in each row of pixel P is turned on; when transistor is on, a data signal is fed to a corresponding data line, one of Data (1) to Data (N), responding to a designated pixel P. Accordingly, the designated pixel, which is intended to be lightened up, corresponding to a specific address is selected and fed with the data signal. In addition, the different voltage levels in the data signal represent different luminance of pixel P.

According to the driving method in the related art, when a pixel is lightened up, the voltage of the capacitor C corresponding to the pixel must be kept at a high level during the whole display period, thus the gate of the corresponding transistor Tb is always kept at the high voltage level, and there is always a current flow through the transistor Tb, which results in the transistor Tb's threshold voltage shift. In detail, when the transistor Tb is formed of a-Si, there will be a gate insulator layer covering the gate of the transistor Tb. As the gate of the transistor Tb keeps at high voltage level, the electron in the channel layer of the transistor will be trapped in the gate insulating layer, which in general, is formed of silicon nitride ($SiN_X$). Thus the voltage level, required to turn on the transistor Tb, on the gate is raised, i.e., the threshold voltage of the transistor Tb is raised. In addition, because the voltage level applied on the transistor Tb from the capacitor C is fixed, the raise of the threshold voltage of the transistor Tb will result in a decline in the current flow through the transistor Tb, thus obscuring the organic light emitting diode (OLED). In a long term, not only the luminance of the OLED will be decreased, but also some more serious problems will happen to transistor Tb.

In light of the problems mentioned above, one kind of related art use alternative method to drive the active matrix type display device with its circuit configuration unchanged. As shown in FIG. 1C, it illustrates the timing chart of a plurality of driving pulse sequences, wherein the period required to display a frame on the display device is defined as display period I, which includes a first period IA and a second period IB. At first, within the first period IA, subsequently apply a first pulse A1 to the scan lines, Scan (1) to Scan (M), and apply a date signal to data lines, Data (1) to Data (N). Then apply a second pulse B1 to the scan lines, Scan (1) to Scan (M), to turn on all corresponding transistors Ta, followed by applying a first voltage signal Vb to data lines, Data (1) to Data (N), within the second period IB, thus turning off corresponding transistors Tb. So the time interval which the transistors Tb are turned on is reduce to one half when compared with the previous example illustrated in FIG. 1B. It is the reason why the driving method illustrated in FIG. 1C can suppress the threshold voltage of the transistors Tb from shifting.

Because the traditional electroluminescent display device using a-Si TFT is designed to perform the TFT electricity reset sequence when the screen (display panel) being set black. From activating the first scan line to black-screen-setting, the foregoing time interval is different from the following time interval, from activating the last scan line to black-screen-setting. Specifically, because the first scan line, in the timeline, is the first shown on screen, the corresponding pixels continue emitting light from the beginning. After the voltage levels in the data signal have been applied to the corresponding last scan line, all the pixels, including the pixels from the first scan line to the last scan line, on the screen will be processed by the TFT electricity reset sequence. So the following phenomenon is resulted—the pixels of the first scan line is obviously brighter, and the pixels of the last scan line is apparently darker.

SUMMARY OF THE INVENTION

Because the drawbacks resulted from the driving method employed by the traditional electroluminescent display device, the present invention propose a method utilized in an electroluminescent display device that can suppress the threshold voltage shifting occurred in the thin film transistor, in addition, the present invention can improve the unevenness in luminance resulted from timing control used by the driving pulses to the traditional electroluminescent display device.

One object of the present invention is to provide a method for driving an electroluminescent display device to avert TFT threshold voltage from shifting, thus the life of the electroluminescent display device can be extended.

The other object of the present invention is to provide a method for driving an electroluminescent display device to prevent unevenness in luminance resulted from timing control implemented by the driving pulses to the traditional electroluminescent display device.

Another object of the present invention is to provide an electroluminescent display device which can perform TFT reset operation when the screen is set black.

The time interval for the electroluminescent display device to display a frame is defined as a display period, wherein, the method for driving the electroluminescent display device in one preferred embodiment of the present invention divides the display period into a first time interval, a second time interval, and a third time interval. At first, drive a plurality of rows of pixels in sequence within the first time interval, respectively, and apply a display data to the plurality of rows of pixels. Then, within the second time interval, respectively drive the plurality of rows of pixels in sequence, and apply a gray level data to the plurality of rows of pixels. Subsequently, reset a plurality of transistors of the plurality of rows of pixels within said third time interval.

When the N type amorphous thin film transistor is utilized in the electroluminescent display device, each pixel has a switching transistor, a driving transistor, a light emitting element, and a capacitor. According to one preferred embodiment of the present intention, the source and gate of the switching transistor are respectively electrically coupled to a corresponding data line and a corresponding scan line, the source and drain of the driving transistor are electively coupled to the display voltage source and the light emitting element respectively. In addition the gate of the driving transistor is electrically coupled to the capacitor, a reset voltage source, and the drain of the switching transistor. One electrode of the light emitting element is electrically coupled to the source of the driving transistor, the other electrode of the light emitting element is electrically coupled to the supplementary voltage source.

The scan line is used to supply a scan voltage to drive the switching transistors within the first time interval and the second time interval, the data line is used to apply the pixel voltage to the driving transistors during the first time interval, and apply the gray level voltage to the driving transistors within the second time interval. The gray level voltage mentioned above is used to drive the corresponding driving transistors, thus make the corresponding pixels display black (from now on, the corresponding pixels is black). The display voltage source, during the first time interval and the second time interval, is used to apply the display voltage to the light emitting element, and the supplementary voltage source, during the first time interval and the second time interval, is used to apply the supplementary voltage to the light emitting element. Furthermore, the reset voltage source is utilized to apply the reset voltage to the driving transistor during the third time interval, wherein the reset voltage is smaller than the adjusting voltage, the display voltage, or supplementary voltage.

BRIEF DESCRIPTION OF THE DRAWINGS

The present invention will now be specified with reference to its preferred embodiment illustrated in the drawings, in which FIG. 1A schematically illustrates the circuit diagram of the pixel matrix of the display panel of the active matrix type electroluminescent display device in the related art.

DESCRIPTION OF THE PREFERRED EMBODIMENT

The electroluminescent display device and the method of driving the same in accordance with the present invention can be better understood by the drawings in connection with the description in the following preferred embodiment.

Figure 2A:
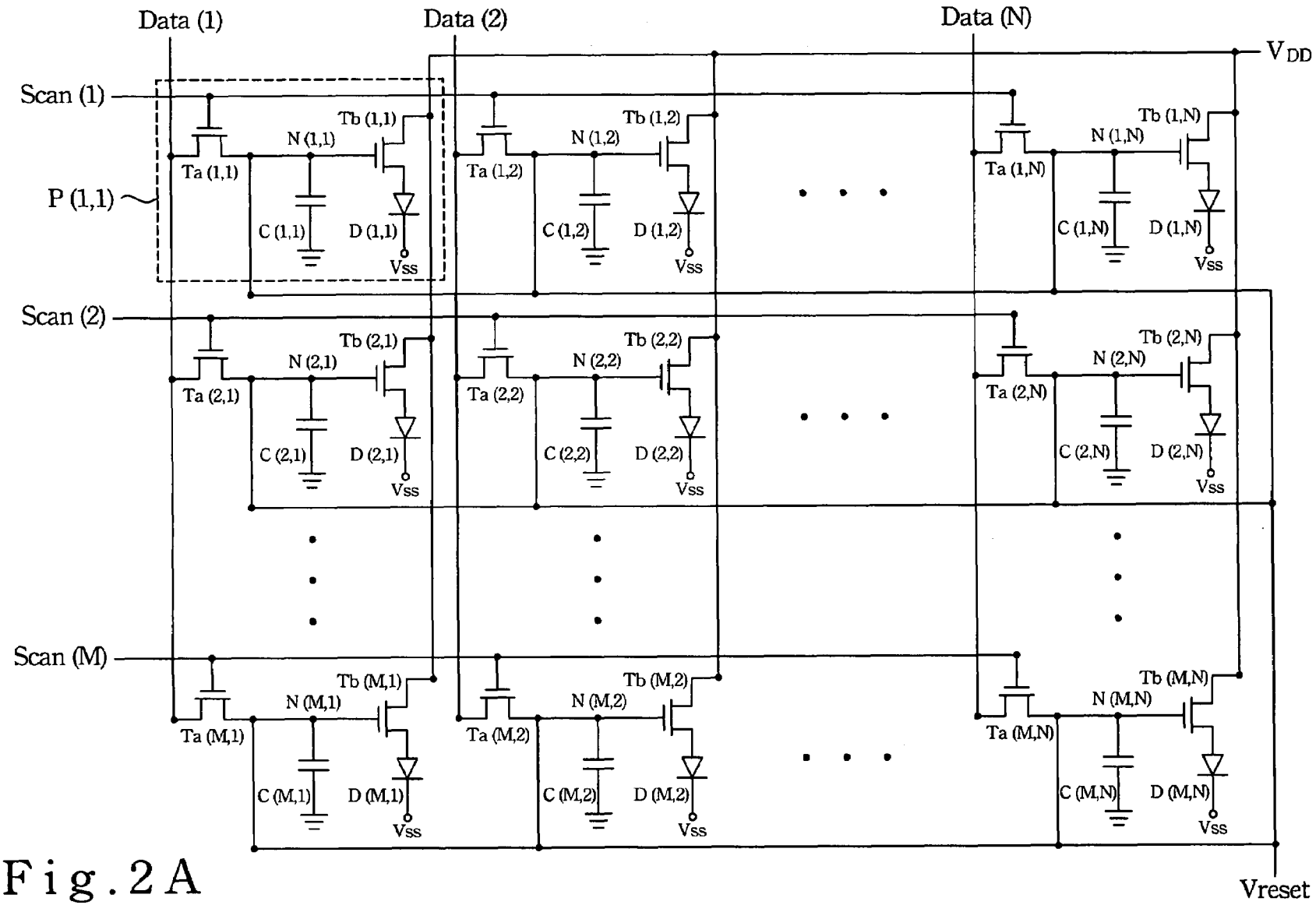
FIG. 2A schematically illustrates the circuit diagram of a pixel matrix of the display panel of the active matrix type electroluminescent display device according to a first preferred embodiment of the present invention.
Figure 2B:
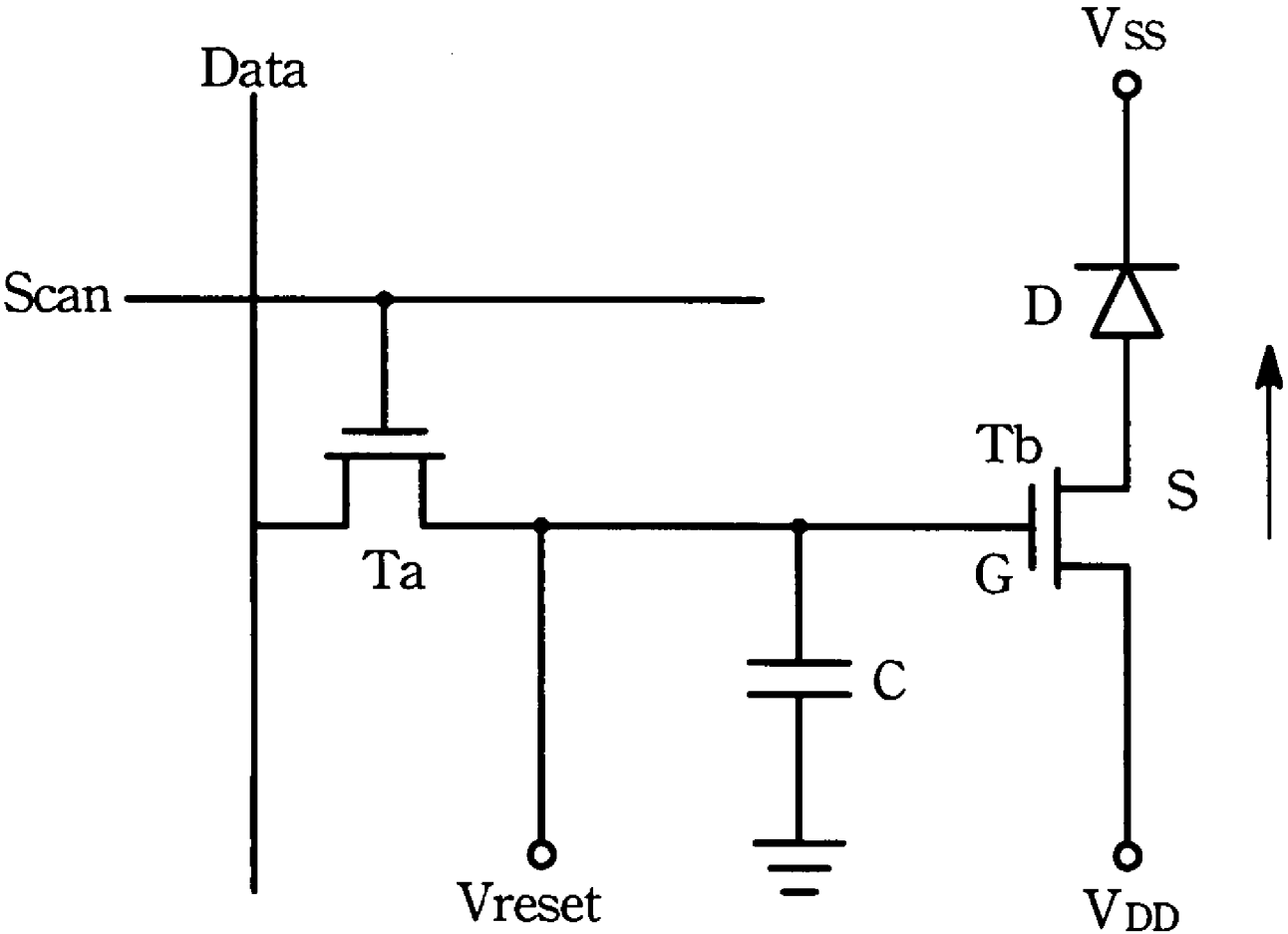
FIG. 2B schematically illustrates the circuit diagram of a pixel according to the first preferred embodiment of the present invention.

The electroluminescent display device, according to the first preferred embodiment of the present invention, includes a plurality of pixels arranged in a matrix as schematically illustrated in FIG. 2A, and the configuration of each pixel is schematically illustrated in FIG. 2B. The electroluminescent display device includes M scan lines, N data lines, and M times N (M×N) pixels, which are used to graphically illustrate a frame within a display period. Each of the pixels P includes a switching transistor Ta, a driving transistor Tb, a light emitting element D, and a capacitor C. The switching transistor Ta has a gate, a source and a drain. The driving transistor Tb has a source S, a gate G and a drain. The source and gate of the switching transistor Ta are coupled to corresponding data line Data and scan line Scan, respectively. The drain and source S of the driving transistor Tb are electrically coupled to the display voltage source $V_{DD}$ and one terminal of the light emitting element D respectively. In addition, the reset voltage source $V_{reset}$ is electrically coupled to the gate G of the driving transistor Tb, and is electrically coupled to the drain of the switching transistor Ta as well as the capacitor C. It is noted that one terminal of the light emitting element D is electrically coupled to source S of the driving transistor Tb, and the other terminal of the light emitting element D is electrically coupled to a supplementary voltage source $V_{SS}$.

In order to describe the operation of the display panel of the electroluminescent display device according to the first preferred embodiment of the present invention, each pixel P denoted with its address, corresponding to a specific data line and scan line, such as pixel P (1,1) is schematically illustrated in FIG. 2A, and which is commentated below. Accordingly, the organic light emitting diode is used as light emitting element D (1,1), and the switching transistor Ta as well as the driving transistor Tb are formed of N-type amorphous silicon thin film transistor (a-Si TFT). The source and gate of the switching transistor Ta (1,1) are electrically coupled to the data line Data (1) and scan line Scan (1) respectively, the drain of the switching transistor Ta is electrically coupled to the capacitor C (1,1) as well as the gate G of the driving transistor Tb (1,1). It is noted that the gate G of the driving transistor Tb (1,1) is electrically coupled to the reset voltage source $V_{reset}$, which can be an externally voltage source, thus a reset voltage is drawn therefrom, and the reset of the driving transistor Tb (1,1) is made possible in the present invention. Besides, the drain of the driving transistor Tb (1,1), which is also a thin film transistor, is electrically coupled to the display voltage source $V_{DD}$ (in FIG. 2B), and the source S of the driving transistor Tb (1,1) is electrically coupled to the anode of the light emitting element D (1,1). Therefore, the display voltage source $V_{DD}$ can provide a display voltage to the anode of light emitting element D (1,1), in addition, the electricity reset of the driving transistor Tb (1,1) is also made possible by the display voltage source $V_{DD}$ which applying an adjusting voltage to the drain of the driving transistor Tb (1,1). The cathode of the light emitting element D (1,1) is electrically coupled to the supplementary voltage source $V_{SS}$, which provides supplementary voltage to the cathode of the light emitting element D (1,1), in addition, the supplementary voltage source $V_{SS}$ also provides an adjusting voltage to the source S of the driving transistor Tb (1,1), and made the reset possible.

Figure 1A:
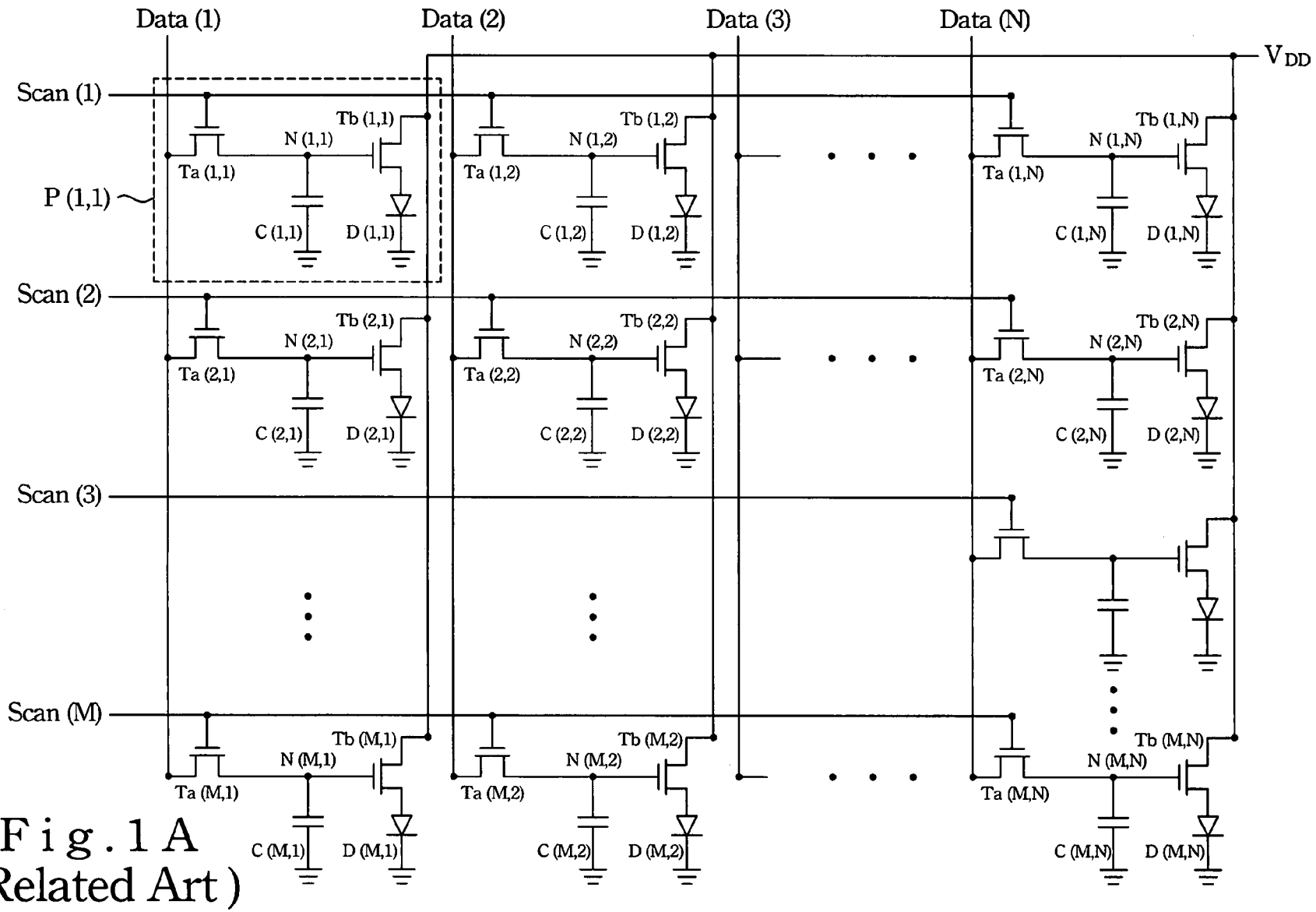
Fig. 1A (Related Art)
FIG. 1B is a traditional timing chart of a plurality of driving pulse sequences which are used to drive the circuit shown in FIG. 1A.
FIG. 1C is the other traditional timing chart of a plurality of driving pulse sequences which are used to drive the circuit shown in FIG. 1A.
Figure 1B:
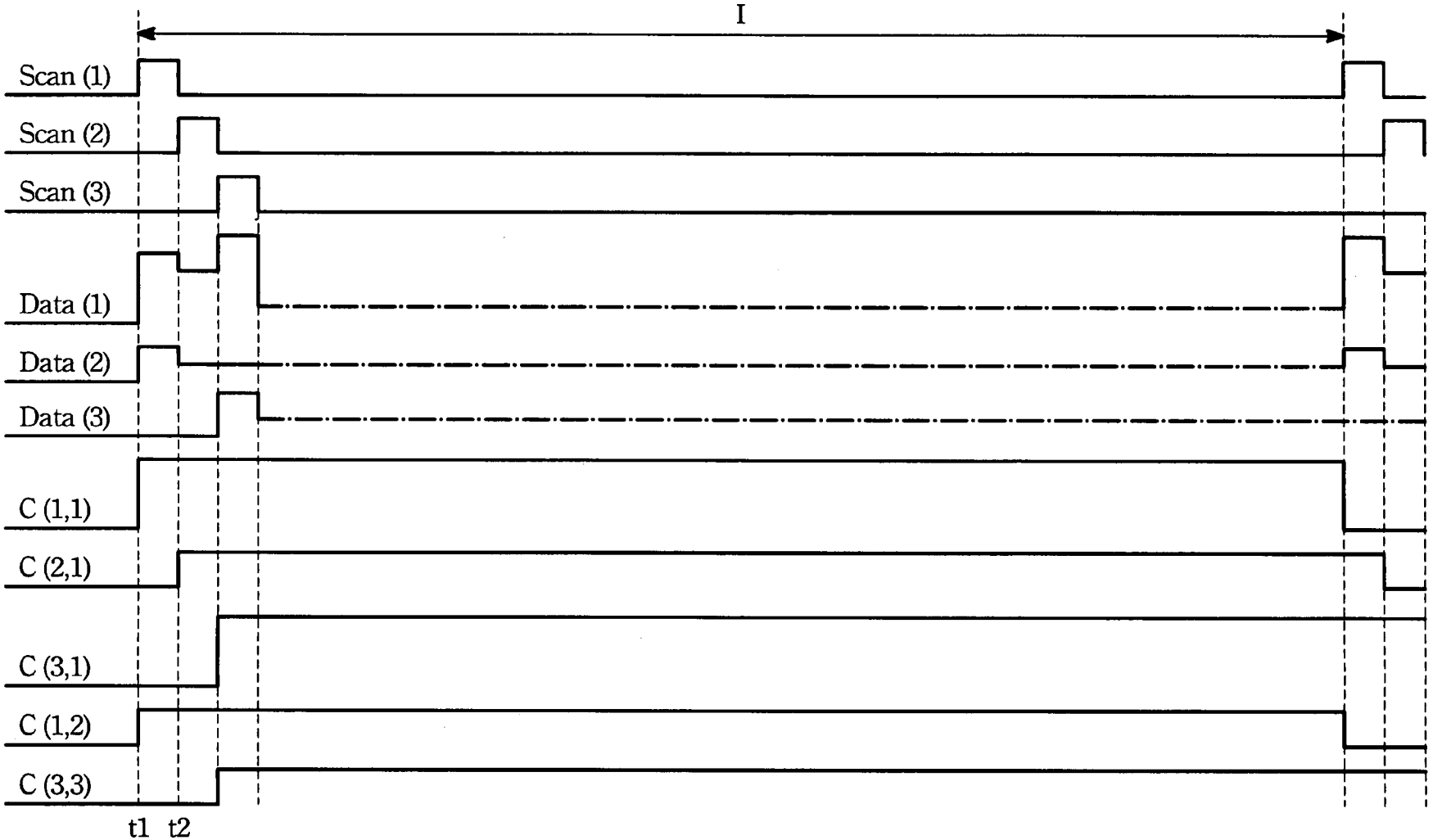
Fig. 1B (Related Art)
Figure 1C:
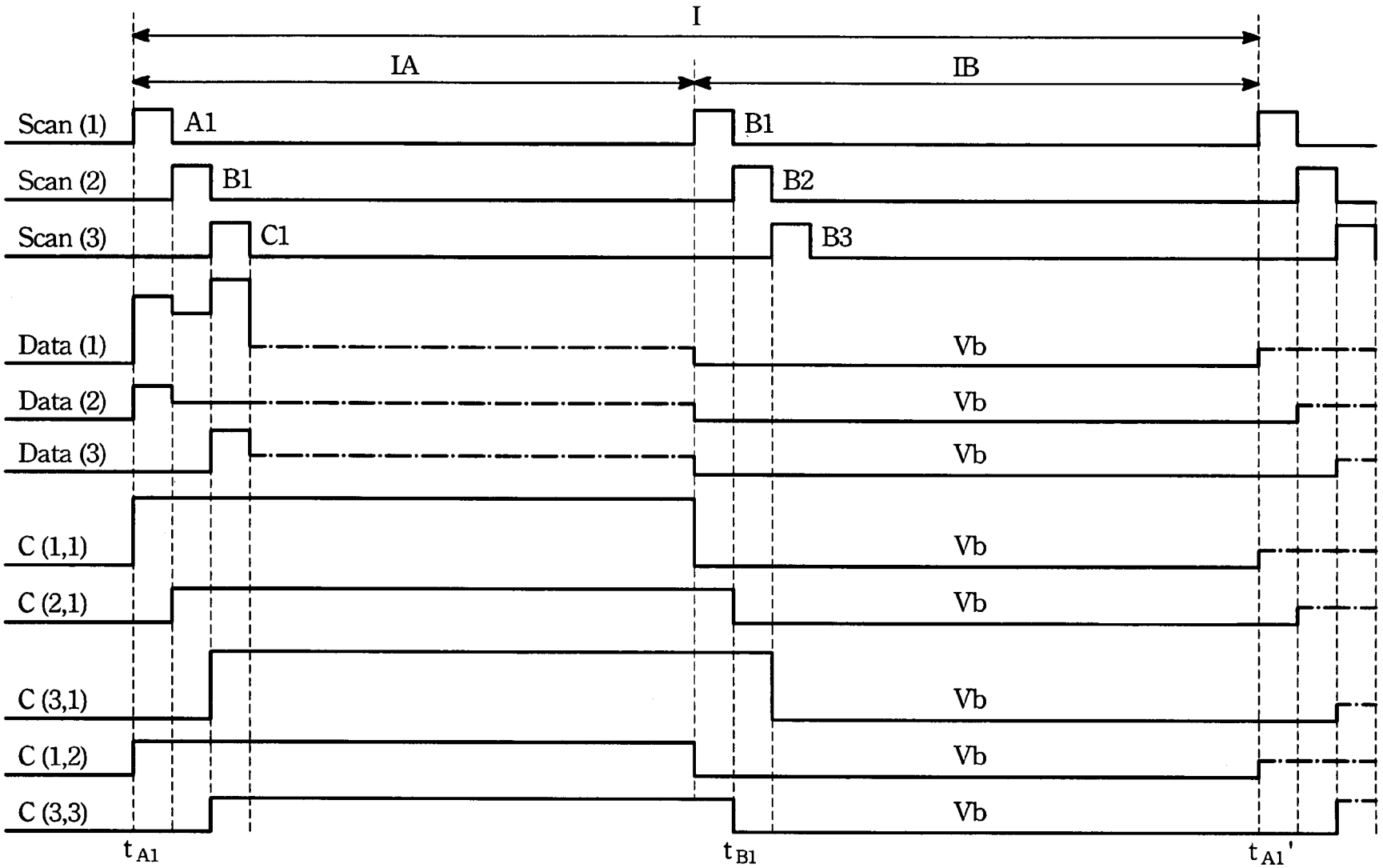
Fig. 1C (Related Art)
Figure 2C:
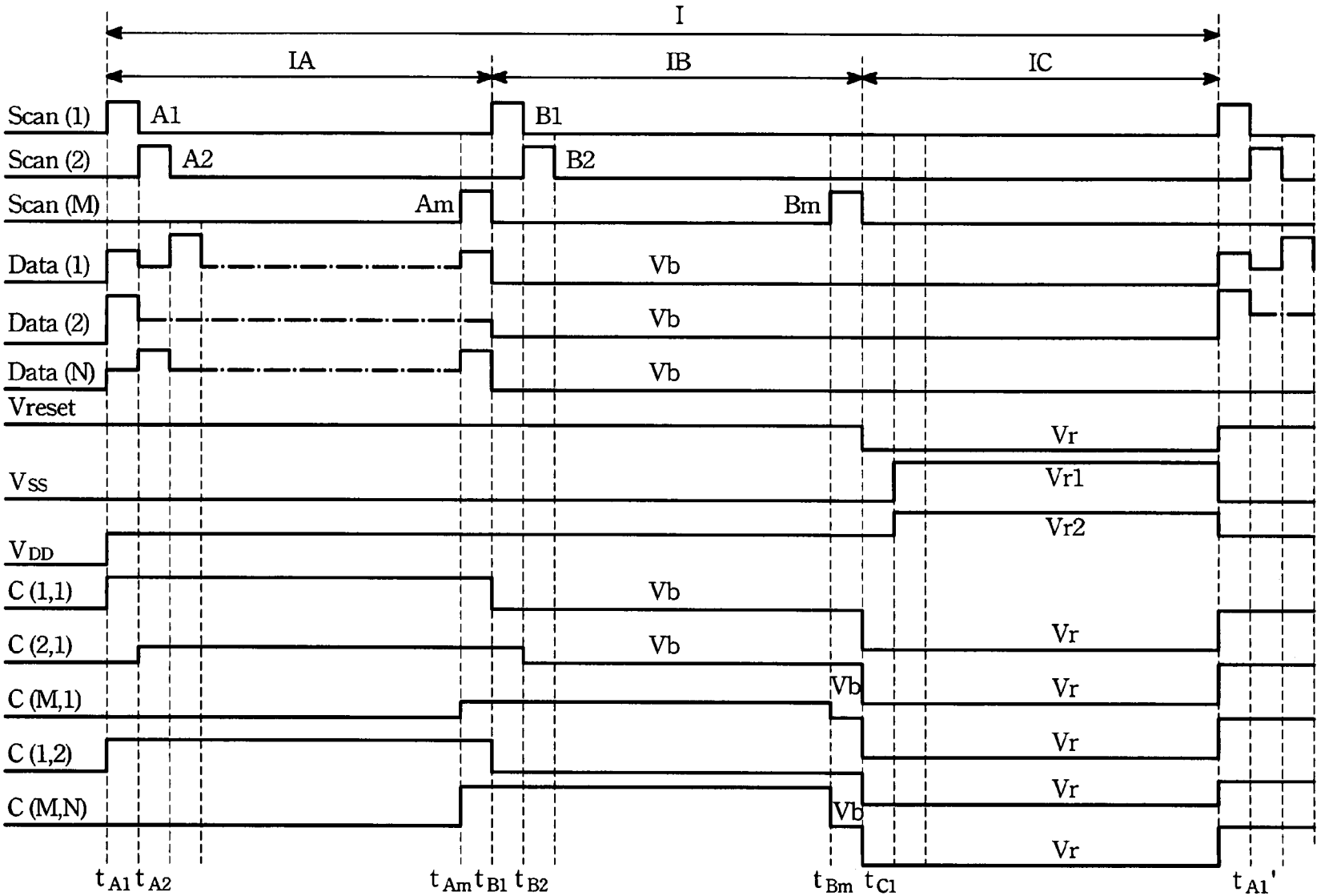
FIG. 2C is a timing chart of a plurality of driving pulse sequences which are used to drive the circuit shown in FIG. 2A.

In comparison with FIGS. 1B and 1C, the time chart of a plurality of driving pulse sequence utilized to drive the circuit in the present invention shown in FIG. 2A is schematically illustrated in FIG. 2C. It is noted that a different driving method utilized in the present invention is implemented by adopting different driving pulse sequence, as exemplified in FIG. 2C, the display period I at least includes a first time interval IA, a second time interval IB, and a third time interval IC. Within the first time interval IA, subsequently drive a plurality of rows of pixel, as shown in FIG. 2A, in the longitude order, and provide a display data to the plurality of rows of pixels. Within the second time interval IB, drive the plurality of rows of pixel, and provide a gray scale data to each gate of a plurality of driving transistors Tb associated with the plurality of rows of pixels. Finally, reset the electricity of the driving transistors Tb associated with the plurality of rows of pixels within the third time interval IC.

In order to better understand the driving method mentioned above, it is further detailed in the following description. Within the first time interval IA, apply scan voltages A1 to Am respectively to the scan lines Scan (1) to Scan (M), as shown in FIG. 2A. Accordingly, switching transistor Ta in all pixels from the first row to the M'th row has been turned on, then apply a pixel voltage to data lines from Data (1) to Data (N), thus the pixel voltage is transmitted through transistor Ta to the gate G of the driving transistor Tb and to the capacitor C. So the operation of the driving transistor Tb depends on the pixel voltage from corresponding data line through the switching transistor Ta, i.e., the driving transistor Tb is thus controlled. At the same time, the voltage level on the capacitor C should be the same as the pixel voltage, and the turned-on driving transistor Tb provides voltage difference across the light emitting element D, and make it emit light. As illustrated in FIG. 2A and FIG. 2B, two electrodes of the light emitting element D are applied with the display voltage (from $V_{DD}$) and supplementary voltage (from $V_{SS}$) respectively. So the luminance of the light emitting element D changes when it's corresponding pixel voltage changes. Within the second time interval IB, further apply scan voltages B1 to Bm respectively to the scan lines Scan (1) to Scan (M), as shown in FIG. 2A. Accordingly, switching transistor Ta in all pixels from the first row to the M'th row has been turned on, then apply a gray level voltage Vb to data lines from Data (1) to Data (N), thus the gray level voltage Vb is transmitted through transistor Ta to the gate G of the driving transistor Tb and to the capacitor C. Accordingly, the appearance of the pixels from the first row to the M'th row is set black during this time interval, and the gray level voltage is stored in the capacitor C. It is also noted that, within this time interval, the display voltage applied to driving transistor Tb is kept constant . Within the third time interval IC, the gate of driving transistor Tb of all pixels from the first row to the M'th row will be applied with a reset voltage $V_r$, which has tuning range larger than the magnitude of gray level voltage Vb, and is supplied by the reset voltage source $V_{reset}$.

In addition, within the third time interval IC, the supplementary voltage source $V_{SS}$ applied a first adjusting voltage $V_{r1}$ to the source of the driving transistor Tb within each pixel from the first row to the M'th row, and the first adjusting voltage $V_{r1}$ is higher than the supplementary voltage. Simultaneously, the display voltage source $V_{DD}$ applied a second adjusting voltage $Vr_2$ on drain of driving transistor Tb within each pixel from the first row to the M'th row, and the second adjusting voltage $V_{r2}$ is higher than the display voltage. Usually, both the first adjusting voltage $V_{r1}$ and the second adjusting voltage $V_{r2}$ are positive voltage, so the voltage level on the gate G of the driving transistor Tb is kept at reset voltage $V_r$ by the capacitor C, whereas, the voltage level on the source S and the drain of the driving transistor Tb are respectively kept at the first adjusting voltage $V_{r1}$ and the second adjusting voltage $V_{r2}$. Subsequently, it is obvious that, an electric field, from the source/drain to the gate, is formed within the driving transistor Tb, thus the electrons captured in the gate insulator layer can be forced by the electric field, and thus be released to the channel layer of the driving transistor Tb. In the first preferred embodiment of the present invention, the reset voltage $V_r$ is applied to all the pixels from the first row to the M'th row simultaneously.

In the first preferred embodiment of the present invention, the switching transistor and the driving transistor are both N type transistor. It is noted that, at the time when the N type transistor is turned on, the voltage level on its gate is usually positive. Accordingly, during the second time interval IB, when the appearance of the pixels (display panel) is set black, the gray level voltage Vb mentioned above can either be positive, zero, or negative. However, within the third time interval IC when it is performing electricity reset, it is necessary to ensure that the driving transistor is off. When the N type transistor is utilized, the reset voltage $V_r$ has better be a zero or negative voltage level, when the depletion type N transistor is utilized, because there will still be a small current passing through the channel of the transistor even if the reset voltage $V_r$ is zero, this is the reason why a negative voltage level is preferred for the reset voltage $V_r$. In the first preferred embodiment of the present invention, the step—applying the reset voltage, can only be performed after the step—applying a gray level voltage to each gate of the driving transistors associated with the pixels of the M'th row, has been performed like the process mentioned above.

In the foregoing preferred embodiment of the present invention, the transistor Ta and Tb are both N type transistor, so the majority of the charges trapped in the gate insulator layer are electron, and the field used to physically perform electricity reset is in the direction from the source/drain to the gate of respective transistor. Under this scenario, the reset voltage $V_r$ should be smaller than the first adjusting voltage $V_{r1}$ and the second adjusting voltage $V_{r2}$. In addition, the reset voltage $V_r$ is usually lower than the gray level voltage Vb, the first adjusting voltage $V_{r1}$ is higher than the supplementary voltage level, and the second adjusting voltage $V_{r2}$ is higher than the display voltage. On the contrary, when the P type transistor is used instead of N type transistor in this embodiment, the majority of the charges trapped in the gate insulator layer will be drifted in the same direction of the electric field. It is necessary, when performing electricity reset, to construct an electric field from the gate to the source/drain of respective transistor. Obviously, apply a positive reset voltage $V_r$ to the gate, and a negative first adjusting voltage $V_{r1}$ as well as a negative second adjusting voltage $V_{r2}$ respectively to the source and drain of the corresponding transistor is a solution.

Within the display period I, the first row of pixel being driven is at the time $t_{A1}$ (FIG. 2C) within the first time interval IA, and next the first row of pixel being driven is at the time $t_{A2}$ within the second time interval IB. The second row of pixel being driven is at the time $t_{B1}$ (FIG. 2C) within the first time interval IA, and next the second row of pixel being driven is at the time $t_{B2}$ within the second time interval IB. The time interval between $t_{A1}$, and $t_{A2}$ is equal to the time interval between $t_{B1}$ and $t_{B2}$, this relationship can be inferred to other time intervals. In conclusion, from the time when the scan voltage is applied to the J'th row pixel to the time when the gray level voltage Vb is applied to the J'th row pixel, the time interval mentioned above is equal to the following time interval, from the time when the scan voltage is applied to the K'th row pixel to the time when the gray level voltage Vb is applied to the K'th row pixel. The number J and K are both larger than or equal to 1 as well as smaller than or equal to M. In addition, by changing the interval, which is between the time applying scan voltage Ai (i=1~M) (FIG. 2C) and the time applying scan voltage Bi (i=1~M), combined with changing the timing when the reset voltage $V_r$ is applied, the adjustment of the proportions of the first time interval IA, the second time interval IB, and the third time interval IC within the display period I is made possible. In the first preferred embodiment, every one of the first time interval IA, the second time interval IB, and the third time interval IC are about one third of the display period I, so the time interval for each row of pixel to emit light is only one third of the display period I. It is noted that the foregoing ratio can be further reduced by adjusting those factors mentioned above.

In general, the display period can be 16.7 ms, i.e., 60 frames will be illustrated within one second, so the input of the scan voltage, pixel voltage, reset voltage, and adjusting voltage must be finished within 16.7 ms. Take the first row of pixel as an example, the driving transistors from Tb (1,1) to Tb (1,N) are turned on during the time interval from $t_{A1}$ to $t_{B1}$, thus the organic light emitting diodes D (1,1) to D (1,N) emit light during the time interval $t_{A1}$ to $t_{B1}$. During the time interval from $t_{B1}$ to $t_{C1}$, the organic light emitting diodes D (1,1) to D (1,N) can be turned on but set black, or even turned off. During the time interval from $t_{C1}$ to $t_{A1'}$, the organic light emitting diodes D (1,1) to D (1,N) are reset. In addition, in order to raise the average luminance of each pixel, the luminance of the organic light emitting diodes D (1,1) to D (1,N) should be increased, and it can be implemented by raising the level of the pixel voltage.

Figure 3A:
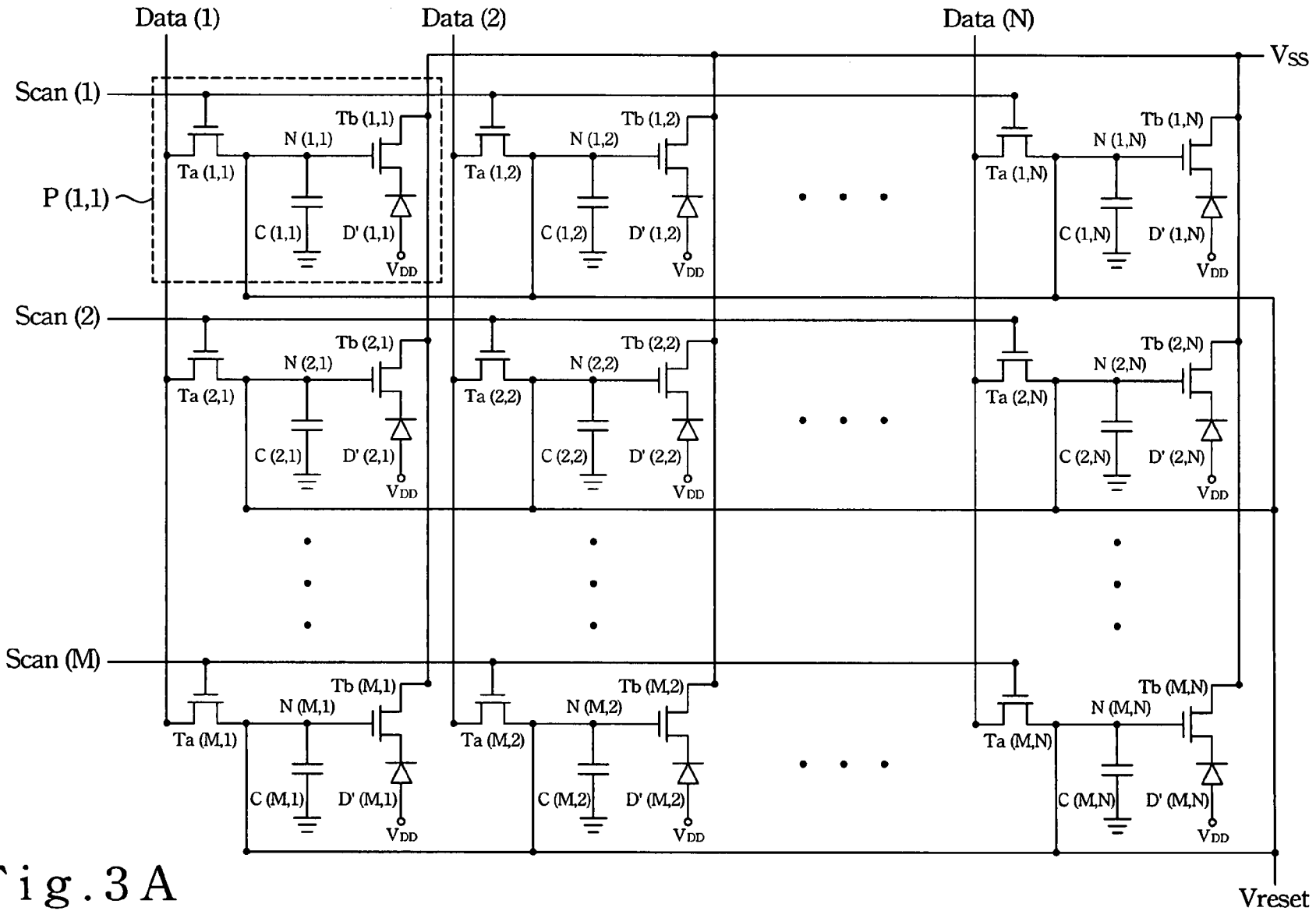
FIG. 3A schematically illustrates the circuit diagram of a pixel matrix of the display panel of the active matrix type electroluminescent display device according to a second preferred embodiment of the present invention.
Figure 3B:
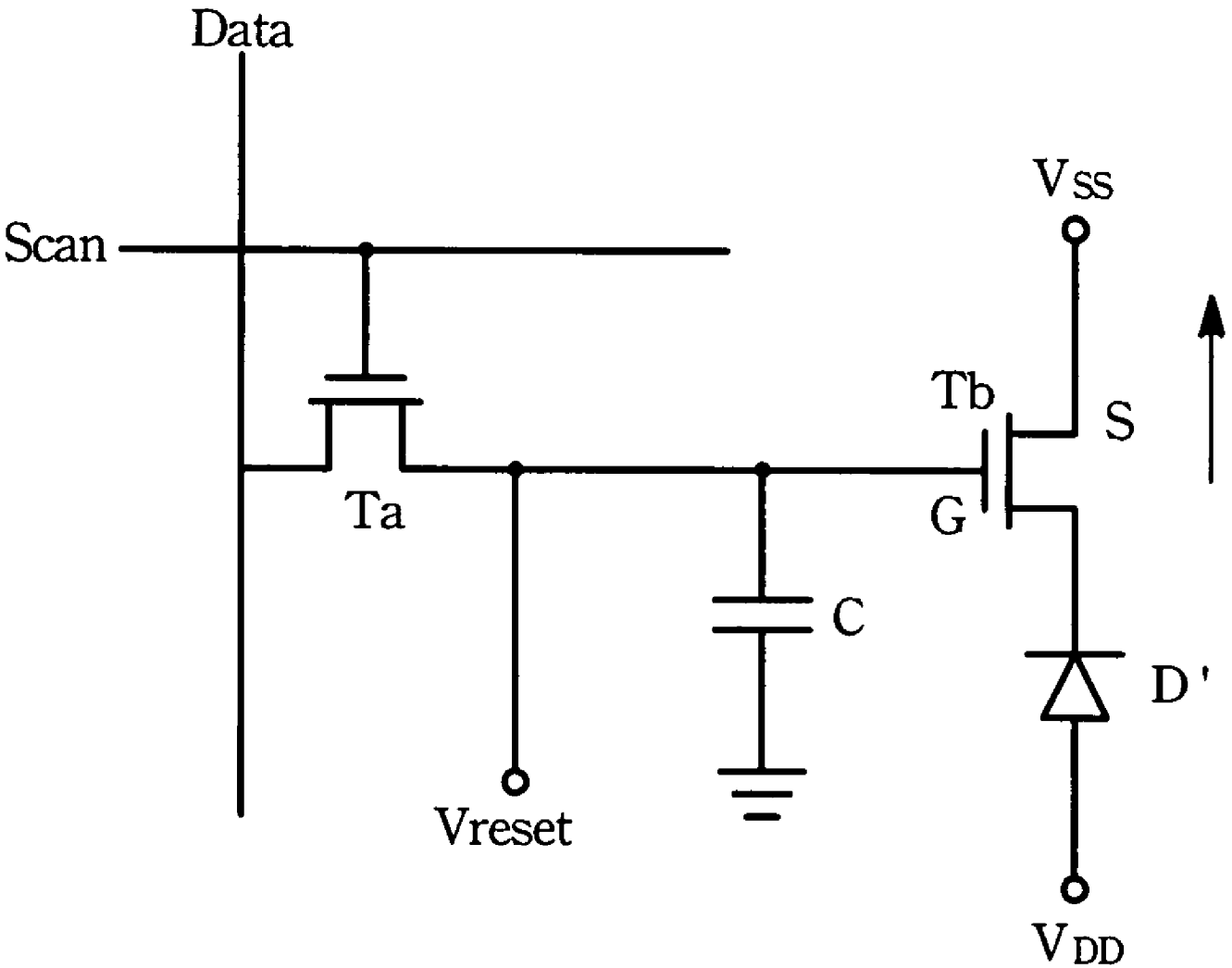
FIG. 3B schematically illustrates the circuit diagram of a pixel according to the second preferred embodiment of the present invention.

Please refer to FIG. 3A and FIG. 3B, in order to describe the operation of the display panel of the electroluminescent display device according to the second preferred embodiment of the present invention, each pixel P denoted with its address, corresponding to a specific data line and scan line, such as pixel P (1,1) is schematically illustrated in FIG. 2A, and which is commentated below. It is noted that in the second preferred embodiment, the an inverted type organic light emitting diode D' is utilized in place of the organic light emitting diode D. Accordingly, the cathode of the inverted type organic light emitting diode D', is coupled to the drain of the driving transistor Tb. Referring to FIG. 3B which takes the pixel P (1,1) as an example demonstrating the configuration of all pixels, in which the source S and gate G of the switching transistor Ta (1,1), which is also a TFT, are coupled to the data line Data (1) and scan line Scan (1) respectively. In addition the drain of the switching transistor Ta (1,1) is coupled to the capacitor C and the gate G of the driving transistor Tb. In addition, the gate G of the driving transistor Tb (1,1), which is also a TFT, is coupled to a reset voltage source $V_{reset}$, which can be an externally voltage source, thus a reset voltage $V_r$ is drawn therefrom, and the reset of the driving transistor Tb (1,1) is made possible in the second preferred embodiment of the present invention. Besides, the drain of the driving transistor Tb (1,1), is electrically coupled to the cathode of the organic light emitting diode D' (1,1), and the anode of D' (1,1) is coupled to the display voltage source $V_{DD}$, thus an adjusting voltage and a display voltage are drawn therefrom. The source S of the driving transistor Tb (1,1) is electrically coupled to the supplementary voltage source $V_{SS}$, from which an adjusting voltage as well as a supplementary voltage are drown.

No matter which preferred embodiment of the present invention is referred, i.e., no matter source or drain of the driving transistor is coupled to the light emitting diode, what can be affected is that the stability of the adjusting voltage provided by either display voltage source $V_{DD}$ or supplementary voltage source $V_{SS}$, it never affects the polarity, i.e., positive or negative, of the adjusting voltage, neither does it affect the timing of applying the adjusting voltage. The driving pulse sequence illustrated in FIG. 2C can also be utilized to drive the circuit diagram shown in FIG. 3A.

As the N type transistor is utilized in the second preferred embodiment of the present invention, the reset voltage is set lower than the adjusting voltage. The transistor coupled to the organic light emitting diodes has to be in the turned off state during the reset process being proceeded, otherwise the corresponding organic light emitting diodes will emit light, and result in interference as well as irregularity on display panel of the electroluminescent display device. Subsequently, after the reset voltage has been applied, the second preferred embodiment of the present invention applied a first adjusting voltage $V_{r1}$ and a second adjusting voltage $V_{r2}$ respectively to the source and drain of corresponding transistor. In the second preferred embodiment of the present invention, the gray level voltage ranges from about 0 to about 15 V (Volt), preferably about 0 to about 5 V, the adjusting voltage ranges from about 0 to about 50 V, preferably about 0 to about 20 V, and the supplementary voltage is about 0 V.

Though N type transistor is used in exemplary description in the foregoing embodiments of the present invention, the other type of transistors can also be used in the present invention. For example, if a non-inverted type OLED is employed in the pixel of the present invention, which is shown in FIG. 3B, and the P type transistor is utilized as driving transistor, then the configuration can be modified as the following description. The source of the transistor can be coupled to the supplementary voltage source $V_{SS}$, and the drain of the transistor can be coupled to the voltage source $V_{DD}$ through the OLED mentioned above. Accordingly, in the present invention, P type transistor can also be used in the electroluminescent display device, and it does not make the method to drive the electroluminescent display device useless.

Figure 4:
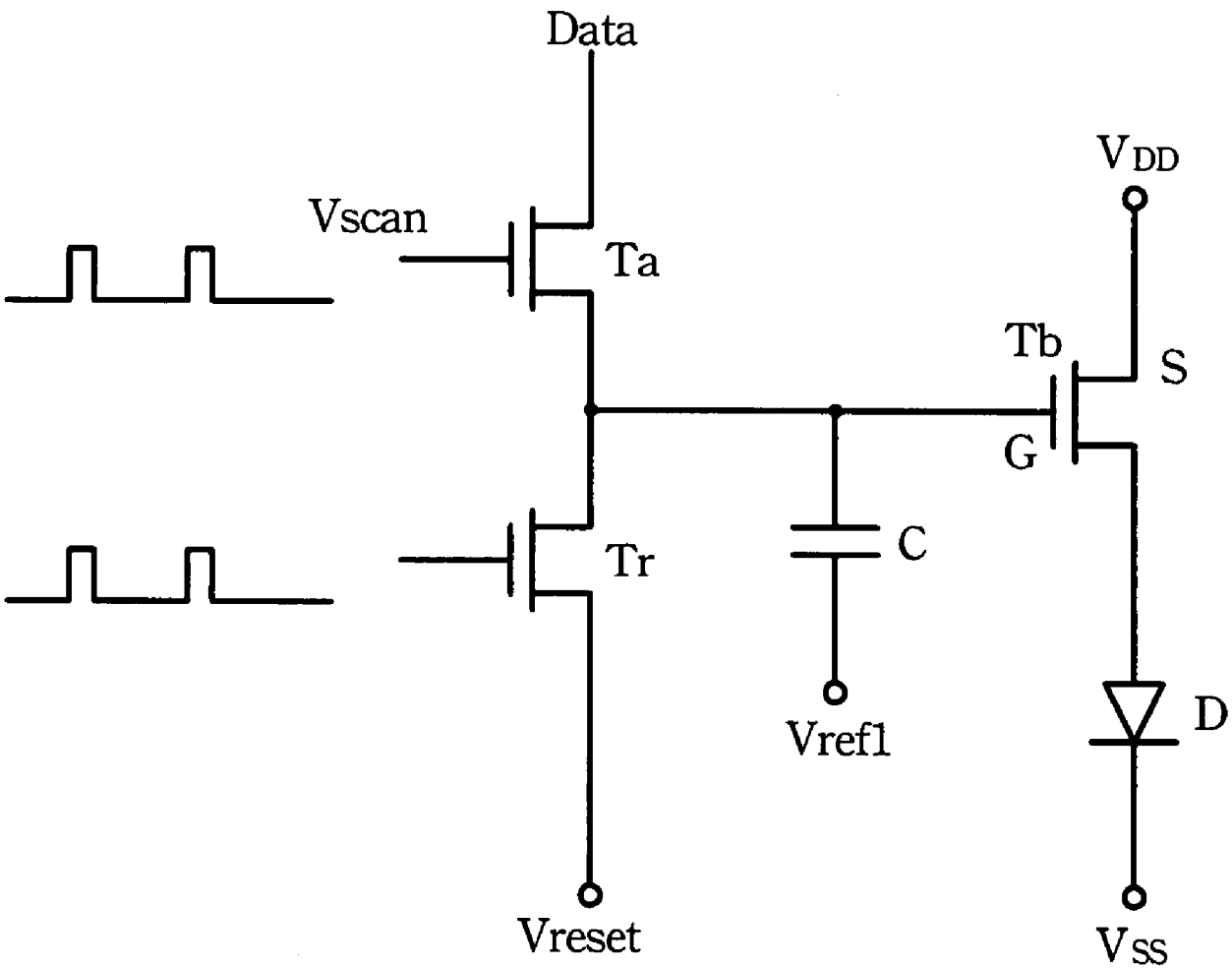
FIG. 4 schematically illustrates the circuit diagram of a pixel according to a third preferred embodiment of the present invention.

Please refer to FIG. 4, it is the third preferred embodiment of the present invention, in which the configuration of a pixel is illustrated, it at least includes switching transistor Ta, a driving transistor Tb, light emitting device D, capacitor C and a thin film transistor Tr. The thin film transistor Tr is used as a switch to the reset voltage source $V_{reset}$, and one terminal of the capacitor C is coupled to the reference voltage source $V_{ref1}$. In addition, the source of the transistor Tr is coupled to the reset voltage source $V_{reset}$, furthermore, the drain of the transistor Tr is coupled to the other terminal of capacitor C, the drain of the switching transistor Ta, and the gate of the driving transistor Tb. The switching transistor Ta being turned off within the third time interval IC, please refer to FIG. 2C, simultaneously, the transistor Tr being turned on to apply the reset voltage to the driving transistor Tb.

Figure 5:
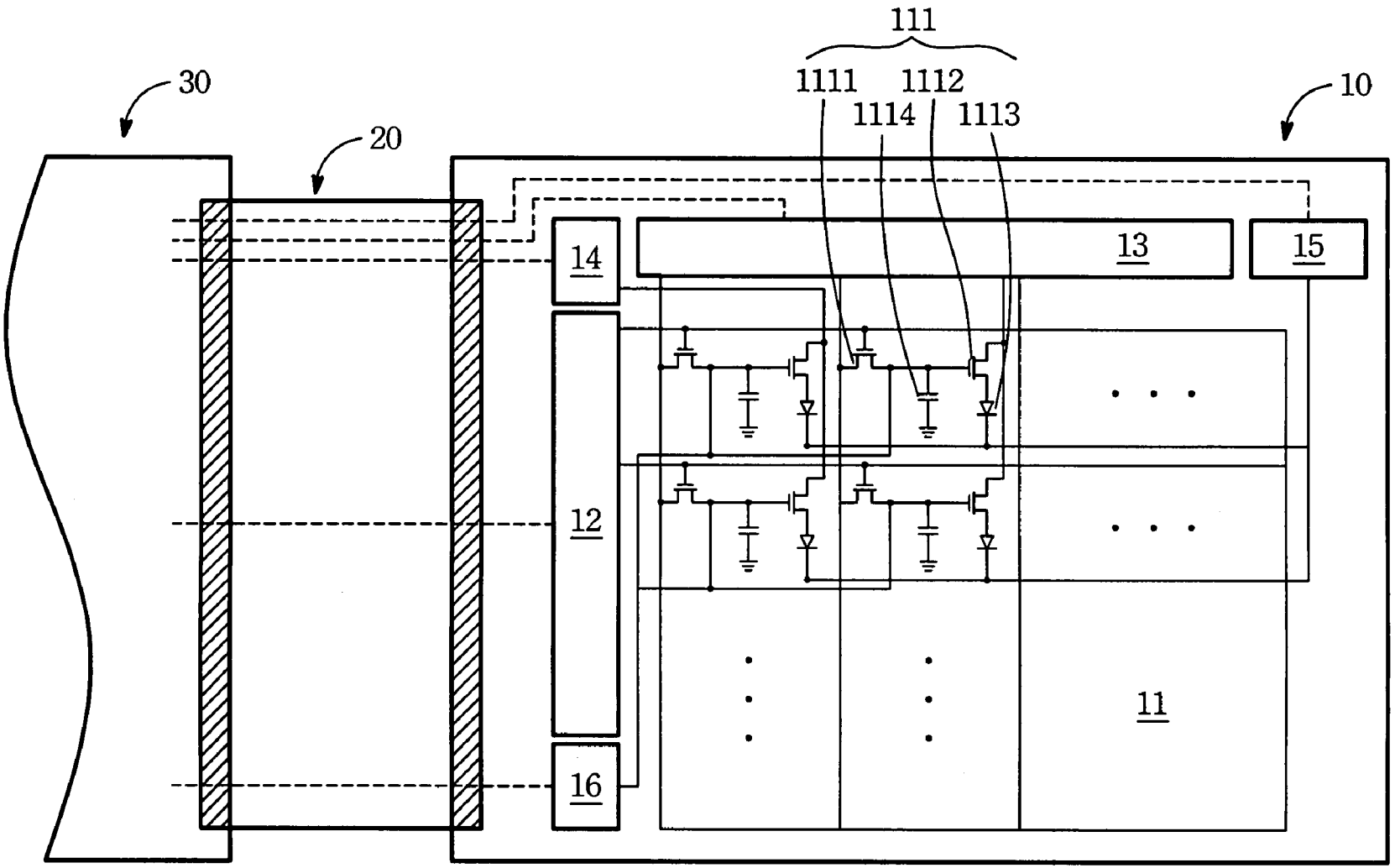
FIG. 5 schematically illustrates the configuration of an electroluminescent display device according to the present invention.

The exemplary structure of an electroluminescent display device according to the present invention is schematically illustrated in FIG. 5, the electroluminescent display device 10 includes a pixel matrix 11, a scan voltage source 12, a data voltage source 13, a display voltage source 14, a supplementary voltage source 15, and a reset voltage source 16. In addition, the pixel matrix 11 includes a plurality of pixels 111, which are arranged in a matrix, and each pixel 111 includes a switching transistor 1111, a driving transistor 1112, and light emitting element 1113. The light emitting element 1113 can be coupled to the drain or source of the driving transistor 1112.

Because the scan voltage source 12 is electrically coupled to the gate of the switching transistor 1111, the scan voltage can be applied thereto, thus the switching transistor 1111 can be turned on during the first time interval and the second time interval of the display period. The data voltage source 13 is electrically coupled to the source of the switching transistor 1111, so the pixel voltage can be applied to the driving transistor 1112 within the first time interval, and subsequently, the gray level voltage can be applied to the driving transistor 1112 within the following second time interval, during which the gray level voltage make the pixel turn black. The display voltage source 14 is electrically coupled to the light emitting element 1113, so the display voltage can be applied to the light emitting element 1113 within the first time interval and the second time interval. The supplementary voltage source 15 is also electrically coupled to one terminal of the light emitting element 1113, and the display voltage source 14, through the driving transistor 1112 in it's turn-on state, is electrically coupled to the other terminal of the light emitting element 1113. The supplementary voltage source 15 can be used to supply the supplementary voltage during the first time interval and the second time interval. The reset voltage source 16 is electrically coupled to the gate of the driving transistor 1112, and it can be used to apply a reset voltage to the driving transistor 1112 during the third time interval.

The scan voltage source 12, the data voltage source 13, the display voltage source 14, the supplementary voltage source 15, and the reset voltage source 16, through a soft printed circuit board 20, are connected to the main board 30, or receive an image signal therefrom. In addition, all the voltage sources mentioned above can be integrated into a signal hardware, e.g., the reset voltage source 16 can be embedded into a scan driver or a data scan driver. Furthermore, each pixel further includes a storage capacitor 1114 which is electrically coupled to the gate of the driving transistor 1112 and the display voltage source 14. During the third time interval, the display voltage source 14 together with the supplementary voltage source 15 are used to apply an adjusting voltage to the light emitting element, and the preferred reset voltage is smaller than the adjusting voltage, the display voltage, or the supplementary voltage.

From the description mentioned above, the present invention not only possess innovation in technology, but also prevail the related art by promoting the benefit previously mentioned. Thus the present invention is believed to fulfill the request for novelty and non-obviousness, which is necessary for being a patent.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

We claim:

1. A method for driving an electroluminescent display device, said electroluminescent display device having a plurality of rows of pixels, each pixel comprising a light emitting element, a switching transistor, and a driving transistor electrically coupled to said switching transistor and said light emitting element, said electroluminescent display device being able to display a frame within a display period, said method comprising the steps of:

dividing said display period into a first time interval, a second time interval, and a third time interval;

driving said plurality of rows of pixels in sequence within said first time interval and said second time interval, respectively;

applying a display data to said plurality of rows of pixels within said first time interval;

applying a gray level data to said plurality of rows of pixels within said second time interval; and resetting a plurality of transistors of said plurality of rows of pixels within said third time interval, wherein the duration from driving one of said plurality of rows of pixels within said first time interval to driving said one of said plurality of rows of pixels within said second time interval is equal to the duration from driving the other one of said plurality of rows of pixels within said first time interval to driving said other one of said plurality of rows of pixels within said second time interval.

2. The method of claim 1, wherein each of said first time interval, said second time interval, and said third time interval is one third of said display period.

3. The method of claim 1, wherein the step of driving said plurality of rows of pixels in sequence within said first time interval and said second time interval, respectively, comprises the step of applying a scan voltage to drive the plurality of rows of pixels within said first time interval and said second time interval.

4. The method of claim 1, further comprising activating said light emitting element during said first time interval.

5. The method of claim 4, wherein the step of activating said light emitting element during said first time interval comprises the step of applying a display voltage and a supplementary voltage to said light emitting element within said first time interval.

6. The method of claim 5, wherein said display voltage ranges from about 0 to about 20 Volt.

7. The method of claim 5, wherein said supplementary voltage is about 0 Volt.

8. The method of claim 1, wherein the step of applying said display data to said plurality of rows of pixels within said first time interval comprises the step of applying a pixel voltage to said plurality of rows of pixels within said first time interval.

9. The method of claim 8, wherein the step of applying said gray level data to said plurality of rows of pixels within said second time interval comprises the step of applying a gray level voltage to each gate of a plurality of transistors associated with the plurality of rows of pixels within said second time interval, said gray level voltage being smaller than said pixel voltage.

10. The method of claim 9, wherein said gray level voltage ranges from about 0 to about 15 Volt.

11. The method of claim 9, wherein said gray level voltage ranges from about 0 to about 5 Volt.

12. The method of claim 9, further comprising the step of storing said gray level voltage during said second time interval.

13. The method of claim 1, wherein the step of resetting the plurality of transistors of said plurality of rows of pixels within said third time interval comprises the step of applying a reset voltage to each gate of the plurality of transistors associated with the plurality of rows of pixels within said third time interval.

14. The method of claim 13, wherein the step of resetting each of the plurality of transistors of said plurality of rows of pixels within said third time interval further comprises the step of applying an adjusting voltage to each drain or source of the plurality of transistors associated with the plurality of rows of pixels within said third time interval, said resetting voltage being smaller than said adjusting voltage.

15. The method of claim 14, wherein the adjusting voltage is positive.

16. The method of claim 15, wherein the adjusting voltage ranges from about 0to about 50 Volt.

17. An electroluminescent display device comprising:

a pixel matrix, at least one pixel of said pixel matrix comprising:

a switching transistor having a gate, a source and a drain;

a driving transistor having a gate electrically coupled to the drain of said switching transistor;

a capacitor having a terminal coupled to said gate of said driving transistor; and a light emitting element, electrically coupled to said driving transistor, and having a first electrode and a second electrode;

a scan voltage source electrically coupled to the gate of said switching transistor;

a data voltage source electrically coupled to the source of said switching transistor;

a display voltage source electrically coupled to the first electrode of said light emitting element;

a supplementary voltage source electrically coupled to the second electrode of said light emitting element; and a reset voltage source electrically coupled to said gate of said driving transistor, wherein said supplementary voltage source applies a first adjusting voltage to a source of said driving transistor, and said display voltage source applies a second adjusting voltage to a drain of the driving transistor, to form an electric field within the drain/source and the gate of the driving transistor, so that the electric field forces the electrons captured in a gate insulator layer to be released to a channel layer of the driving transistor.

18. The electroluminescent display device of claim 17, further comprising a reference voltage source electrically coupled to the other terminal of said capacitor.

19. A method for driving an electroluminescent display device, said electroluminescent display device having a plurality of rows of pixels, each pixel comprising a light emitting element, a switching transistor, and a driving transistor electrically coupled to said switching transistor and said light emitting element, said electroluminescent display device being able to display a frame within a display period, said method comprising the steps of:

dividing said display period into a first time interval, a second time interval, and a third time interval;

driving said plurality of rows of pixels in sequence within said first time interval and said second time interval, respectively;

applying a display data to said plurality of rows of pixels within said first time interval to turn on the corresponding driving transistors for making the light emitting element emit light;

applying a gray level data to said plurality of rows of pixels within said second time interval to drive the corresponding driving transistors for making the corresponding pixels display black; and resetting a plurality of transistors of said plurality of rows of pixels within said third time interval by applying a reset voltage to form an electric field between a source/drain and a gate of the corresponding driving transistor so that the electrons captured in the gate insulator layer can be forced by the electric field to be released to the channel layer of the corresponding driving transistor.

* * * * *